US006371683B1

(12) United States Patent
Draney et al.

(10) Patent No.: US 6,371,683 B1
(45) Date of Patent: Apr. 16, 2002

(54) STAKEDOWN ASSEMBLY COUPLING FOR A HORIZONTAL DIRECTIONAL DRILL

(75) Inventors: Robert G. Draney, Derby, KS (US); Jeffrey S. Volden, Burlington, IA (US)

(73) Assignee: Case Corporation, Racine, WI (US)

( * ) Notice: Subject to any disclaimer, the term of this patent is extended or adjusted under 35 U.S.C. 154(b) by 0 days.

(21) Appl. No.: 09/495,136

(22) Filed: Jan. 31, 2000

(51) Int. Cl.[7] ..... F16B 21/00

(52) U.S. Cl. ..... 403/325; 403/321; 37/468; 175/77.5

(58) Field of Search ..... 37/468; 175/77.5, 175/122; 403/321, 322.1, 322.3, 322.4, 324, 325

(56) References Cited

U.S. PATENT DOCUMENTS 5,098,252 A * 3/1992 Sheesley et al. ..... 403/324
5,437,341 A * 8/1995 Horn et al. ..... 175/122
5,562,397 A * 10/1996 Albright ..... 37/468
5,692,855 A * 12/1997 Burton ..... 37/468
5,709,276 A * 1/1998 Lee ..... 175/122
6,238,130 B1 * 5/2001 Youngers ..... 403/322.4

FOREIGN PATENT DOCUMENTS

WO WO-9118716 A1 * 12/1991 ..... 403/322.4

* cited by examiner

*Primary Examiner*—Lynne H. Browne
*Assistant Examiner*—Aaron Dunwoody
(74) *Attorney, Agent, or Firm*—Richard G. Lione; Brinks Hofer Gilson & Lione

(57) ABSTRACT

A coupler for a horizontal directional drill for quickly and easily attaching and detaching a stakedown assembly from the drill. The coupler includes a first coupler member and a second coupler member with matching angular front and Fear ends so that the first member fits within the second member. A lever operated locking mechanism releasably locks the two coupler members together in attached relationship.

4 Claims, 4 Drawing Sheets

STAKEDOWN ASSEMBLY COUPLING FOR A HORIZONTAL DIRECTIONAL DRILL

FIELD OF THE INVENTION

The present invention relates generally to horizontal directional drill machines. It relates particularly to a stakedown assembly for a horizontal directional drill machine.

BACKGROUND OF THE INVENTION

A horizontal directional drill machine is a common and well-known machine for installing pipes beneath the ground and generally parallel to the surface. These machines are used in many different applications and are available in a wide range of sizes. Typical applications where a horizontal directional drill machine might be used include the installation of fiber optic cables, electrical cables, gas lines, water systems, or sewer systems. Horizontal directional drill machines are commonly rated in terms of pull-back capacity. Some machines for smaller applications have as little as five thousand pounds of pull-back capacity. Other machines are available with a pull-back capacity of as much as one million pounds.

One alternative to a horizontal directional drill machine is the traditional trencher machine. A trencher machine simply digs a trench into the ground, and after (for example) pipe is laid down in the bottom of the trench, the trench is filled and the pipe is buried. The advantage of a horizontal directional drill machine over a trenching machine is that a pipe can be buried in the ground over long distances without digging a trench. Thus, a horizontal directional drill is particularly desirable when a trench would be difficult or too costly to dig. For example, a horizontal directional drill machine finds particularly advantageous application for installing pipes under roadways, where destruction of the road is expensive and inconvenient to travelers, or under a waterway like a river, where trenching would be impossible.

A unique aspect of a horizontal directional drill machine is the special drill head that is attached to the front end of a pipe to be laid. The drill head has an angled shape which allows the operator to change the direction of the pipe after it has entered the ground. Direction changes are achieved by stopping the pipe and drill head rotation and orienting the drill head at a desired angle. Then, by pushing on the drill pipe without rotating it, the drill head and attached pipe will veer in the desired direction. Thus, by affecting directional changes to pipe travel, a pipe might enter the ground at an angle, travel horizontally over a long distance, and exit the ground at another angle. This ability to change the direction of pipe travel also allows the operator to steer the pipe around underground obstacles like boulders.

In addition to pushing forces which must be applied to the pipe as it is inserted, it is often necessary to pull back on the pipe. This may be necessary when a direction change is not completely successful on the first attempt, or when an underground obstacle like a boulder is encountered. The machine then pulls the pipe and drill head back to permit a direction change.

The push and pull forces that a horizontal directional drill machine must apply to the drill pipe frequently exceed the weight of the machine itself. Therefore, a system is required to anchor the machine and resist these forces. The most common system for anchoring the drill machine comprises the use of stakes mounted on the machine body which are screwed into the ground. The stakes have flighting on their tips and are driven into the ground by applying simultaneous rotational and vertical driving forces to each stake. To drive and remove these stakes, a stakedown assembly is conventionally provided on the end of the drill machine where the drill head enters the ground.

Often it is necessary to move a horizontal directional drill before the entire pipe length has been drilled and the job completed, however. This can occur because another project becomes more urgent or when repairs to the machine are needed. Additionally, horizontal directional drill machines are expensive. Therefore, some operators find it necessary to remove the drill machine from the job site each night to protect their investment. However, in order to achieve optimal drilling results, it is desirable to avoid restaking operations. Among other deleterious effects, the removal and later reinstallation of the stakes can weaken the underlying soil, and thus reduce the push-pull forces that can be resisted.

It is therefore desirable to facilitate quick and easy coupling between the horizontal directional drill and the stakedown assembly. Such coupling would allow the operator to easily disconnect the drill from the stakedown assembly. The stakes could then be left installed in the ground while the drill was transported elsewhere. When the drilling operation is later continued, the drill can be reconnected to the stakedown assembly without the need for a restaking operation.

BRIEF SUMMARY OF THE INVENTION

It is an object of the invention to provide a new and improved coupling for quickly and easily connecting and disconnecting a stakedown assembly and a horizontal drill machine.

According to the invention, the coupling includes a first coupling member that is pivotally attached to the drill and a second coupling member that is integrated with the stakedown assembly. The first coupling member is acutely angled on its front end and obtusely angled on its rear end. The second coupling member has substantially matching angles so that the first member fits within the second member in the attached position.

A locking mechanism is provided for binding the two members together in the attached position. This locking mechanism is installed within the first member. In the preferred embodiment, the locking mechanism includes a tapered pin that wedges into matching holes in the first and second members. A cam is used to engage the pin, while a return spring disengages the pin.

BRIEF DESCRIPTION OF SEVERAL VIEWS OF THE DRAWINGS

The invention, including its construction and method of operation, is illustrated more or less diagrammatically in the drawings, in which.

DETAILED DESCRIPTION OF THE INVENTION

Figure 1:
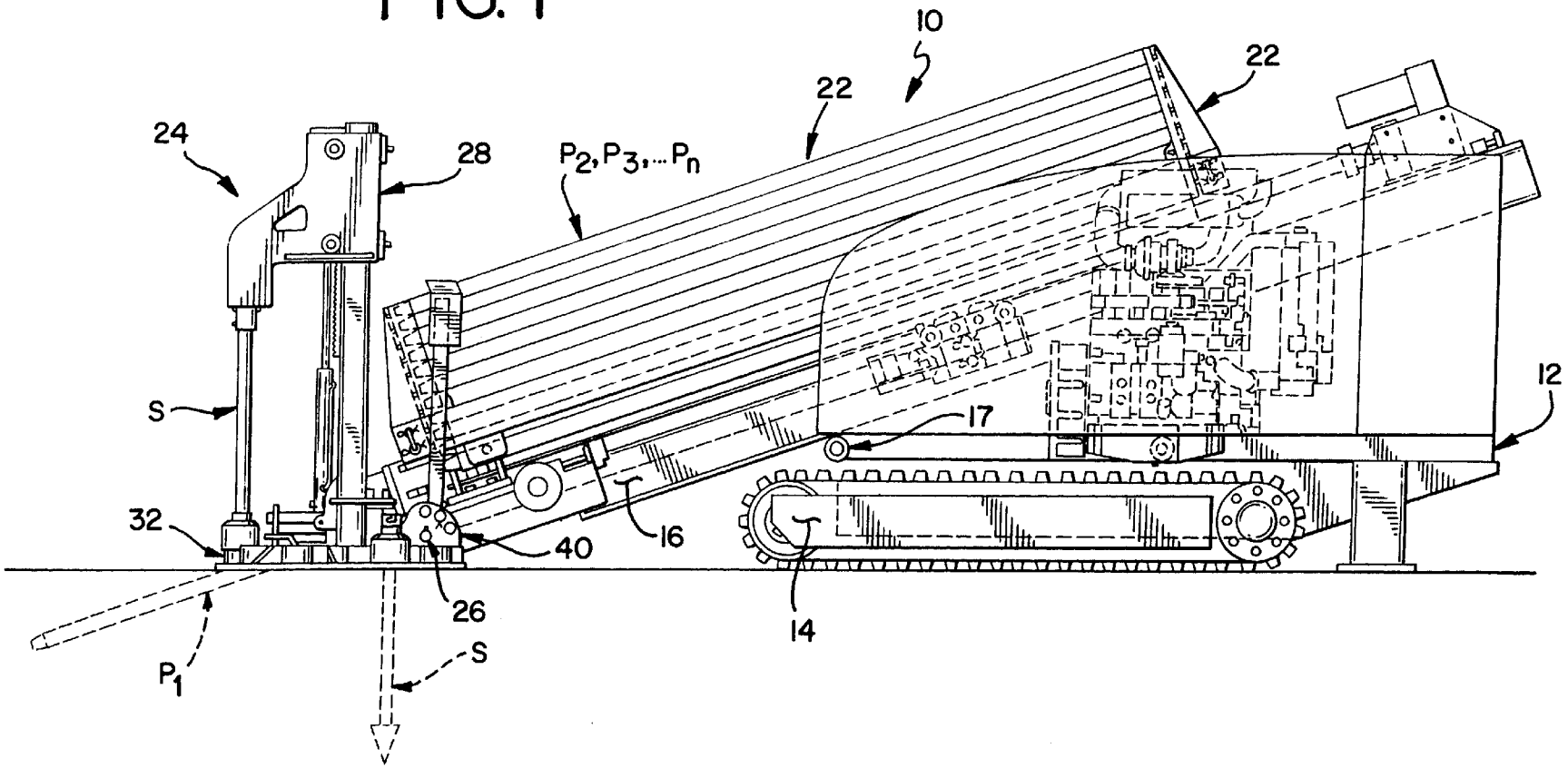
FIG. 1 is a side elevational view of a horizontal directional drill, showing the drill in its operating mode.

Referring now to the drawings, and particularly to FIG. 1, a horizontal directional drill machine is shown generally at 10. The drill machine 10 includes a frame 12 supported by driven tracks 14 for moving the drill machine 10 from place to place.

The drill machine 10 includes a longitudinally elongated boom 16 pivotally mounted on the front end of the frame 12, as at 17. A conventional pipe drill assembly 18 is mounted on the boom 16, extending coextensively therewith. The drill assembly 18 is designed to drill a series of pipe sections $P_1$, $P_2$, $P_3$, et seq., into the ground, in sequence.

In the operating mode of the drill machine 10, the boom 16 is pivoted upward away from the frame 12 so that pipe section $P_1$ extends from the drill assembly 18 and intersects the ground at an angle. A special drill head (not shown) is attached to the front end of the first drill pipe section $P_1$. In order to drill the pipe section $P_1$ into the ground and make any desired directional changes in its path, a variety of push, pull, and rotational forces are applied to the pipe section $P_1$ by the drill assembly 18. The manner in which the drill assembly 18 applies these forces to the drill pipe section $P_1$ are not described, but are well known to those skilled in the art.

As the first pipe section $P_1$ is drilled into the ground, new pipe sections $P_2$, $P_3$, et seq., are successively attached to the rear end of the preceding pipe sections. A cartridge 22 of pipe sections $P_2$,. $P_3$, et seq. is provided on the boom 16 for storing these additional pipe sections, and a semi-automatic or fully automatic loader (not shown) may be provided for attaching them to the preceding pipe sections.

A stakedown assembly 24 is connected to the front end of the drill machine 10. The stakedown assembly 24 is attached to forward end of the boom 16 at a pivot connection 26, which allows the stakedown assembly 24 to be oriented level with the ground surface when the boom is tilted. A coupling 40 embodying features of the present invention is provided to quickly and easily connect the stakedown assembly to the drill machine 10, or disconnect it.

Figure 2:
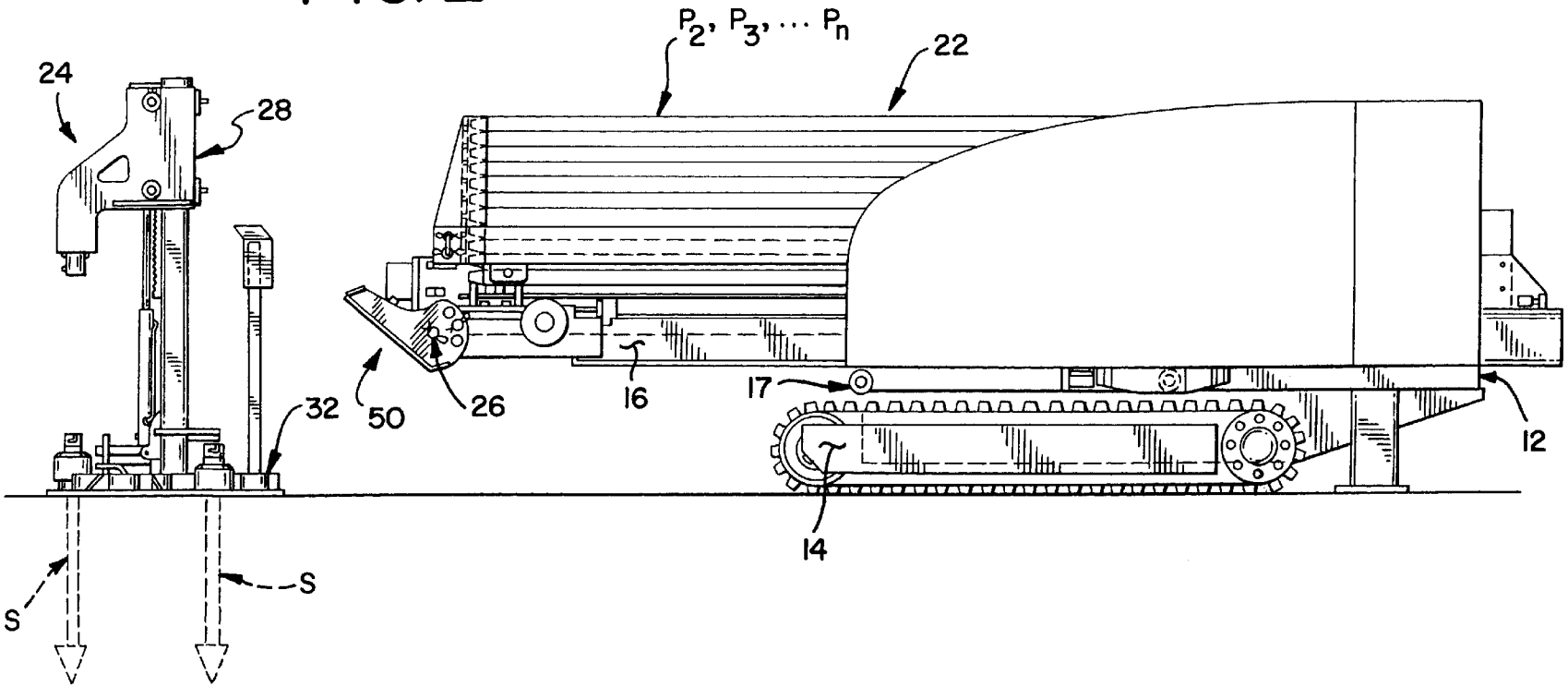
FIG. 2 is a side elevational view of a horizontal directional drill, showing the drill disconnected from the stakedown assembly, where the drill is in its transporting mode and the stakedown assembly is staked to the ground.

Turning now to FIG. 2, the horizontal directional drill machine 10 is shown disconnected from the stakedown assembly 24. The stakes S remain installed in the ground in their original positions. The boom 16 is pivoted back to a horizontal position so that the boom 16 is resting on the frame 12. The drill 10 can then be moved to another place in a conventional manner.

Figure 3:
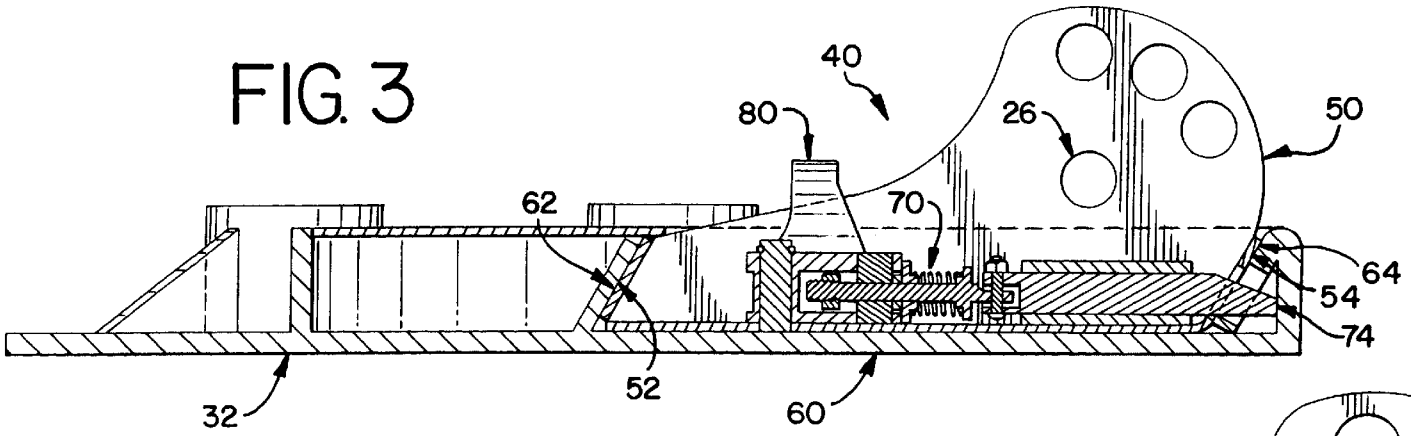
FIG. 3 is an enlarged longitudinal sectional view of the coupling, in a connected position.
Figure 4:
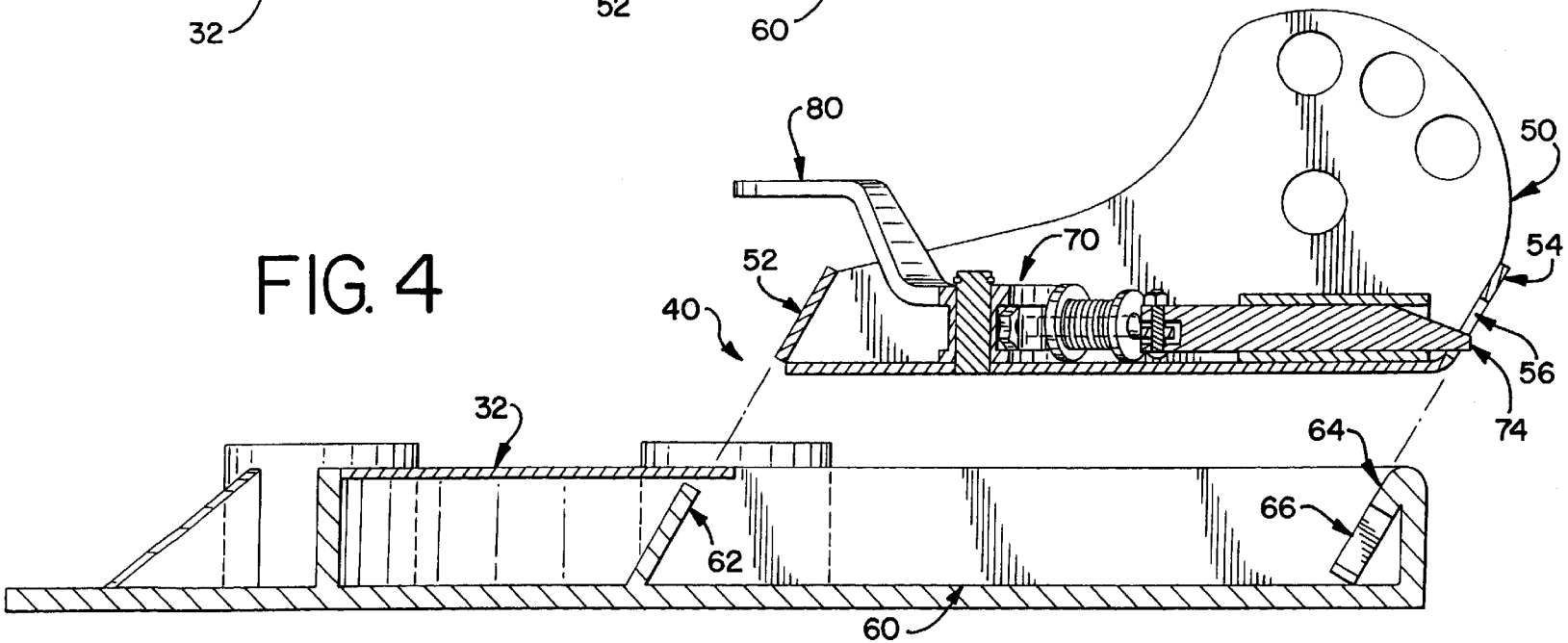
FIG. 4 is a similar view of the coupling, in the disconnected position.

Now referring to FIGS. 3 through 4, where FIG. 3 shows the machine and stakedown assembly 24 connected and FIG. 4 shows them disconnected, the coupling 40 includes a first coupling member 50 and a second coupling member 60. The first coupling member 50 is attached to the drill machine 10 at a pivot connection 26, as previously described. The second coupling member 60 is incorporated as a integral part of the stakedown assembly base plate 32.

Figure 5:
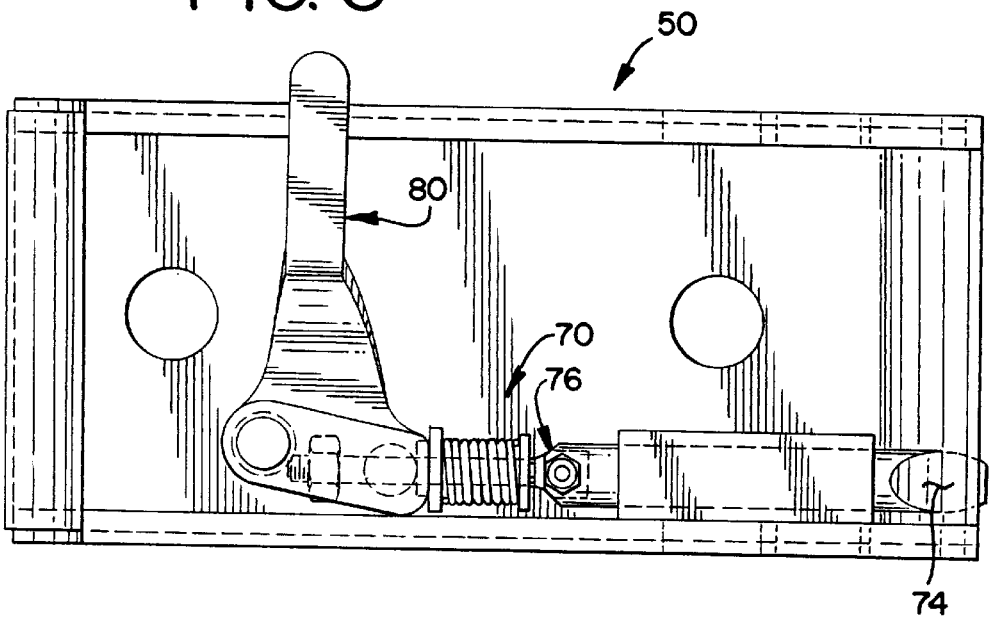
FIG. 5 is a top plan view of a component of the coupling in its locked state.
Figure 6:
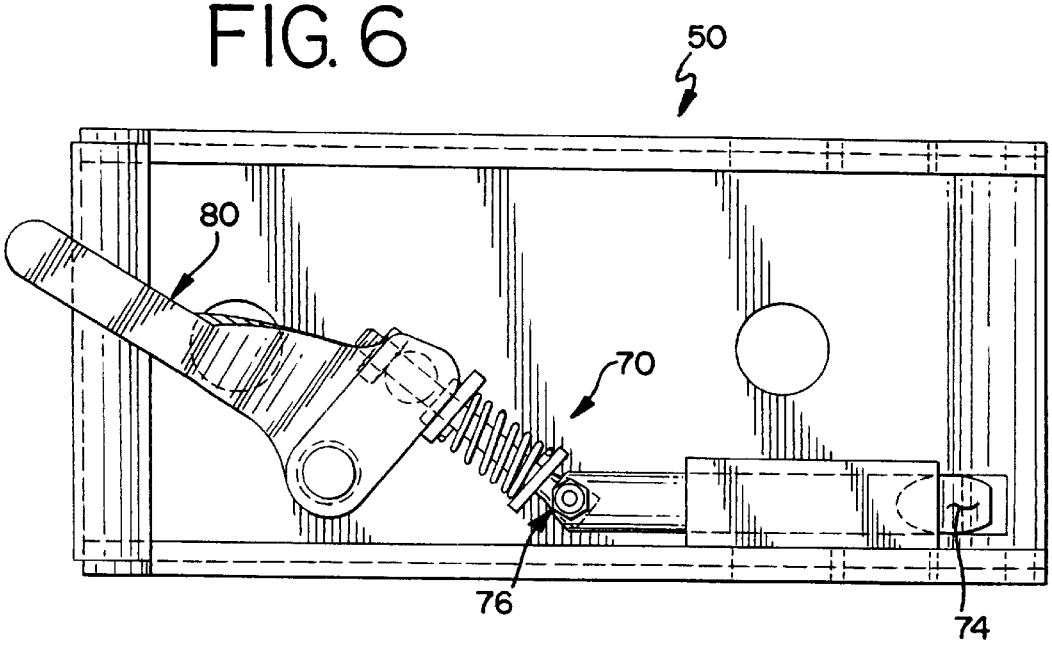
FIG. 6 is a view similar to FIG. 5 showing the coupling component in its unlocked state.

Referring additionally to FIGS. 5 and 6, the first coupling member 50 includes a horizontal base plate 52, a face plate 53, a tail plate 54 and side plates 55. The plates 53 and 54 are each inclined rearwardly at an angle to 30° to the vertical. The side plates 55 connect them.

Mounted on the base plate 52 is a locking mechanism 70. The locking mechanism includes a locking pin 72 slidable longitudinally of the base plate 52 in a sleeve 73. At its rear end 74, the pin 72 has a beveled locking tip 75 which is arranged so that it will pass longitudinally into and through an opening 76 in the tail plate 54 when it slides rearwardly in its sleeve 73. As will later be explained, it is this locking tip 75 which engages and locks the coupling member 50 into the coupling member 60 when the former is properly seated.

The front end 81 of the locking pin 72 has an actuator rod 82 pivotally connected to it, as at 83. The rod 82 extends forwardly of the pin 72 through a connector block 85 pivotally mounted on the toe 86 of an actuator lever 80. The lever 80 is, in turn, mounted on a pivot pin 91 for pivoting movement about the pin 91.

The rod 82 is slidable in the connector block 85. The block 85 is freely rotatable in the toe 86. A nut 91 is threaded onto the end of the rod 82. A coil spring 92 encircles the rod 92 between two washers 93, 94. It will thus be seen that rotating the lever 80 about its pivot pin 91 in a clockwise direction will resiliently push the locking pin 72 into the position shown in FIG. 5, while rotating it in a counter-clockwise direction will subsequently pull the pin forwardly into the position shown in FIG. 6.

The toe 86 of the actuator lever 80 is located at the end of a foot 96 of the lever, as will be seen. The foot 96 extends generally perpendicular to the leg 88 are formed so that a cam 97 is created at their juncture. When the lever 80 is rotated from the position seen in FIG. 6 to that seen in FIG. 5, this foot 96 and cam 97 pass through axial alignment with the pin 72, over dead center relative to a straight line between the pin 91 and pivot connection 83 and the pin 72 is resiliently held in its locking position.

To disengage the pin 72, the lever 80 is turned in the reverse direction, thus, removing the applied force. The return spring 92 is provided to apply a rearward force to the locking pin 72 to return it to the disengaged position.

The second coupling member 60 has a well 101 formed between a rearwardly inclined front wall 102 and a rearwardly inclined rear wall 103. The rear wall 103 has a locking aperture 105 formed longitudinally through it. The well 101 is configured to slidably receive the coupling member 50 into it in the manner shown in FIG. 3. The locking pin 72 can then be moved rearwardly so that its tip 75 extends into the locking aperture 105 and the coupling member 50 is locked in the coupling member 60.

While a preferred embodiment of the invention has been described, it should be understood that the invention is not so limited, and modifications may be made without departing from the invention. The scope of the invention is defined by the appended claims, and all devices that come within the meaning of the claims, either literally or by equivalence, are intended to be embraced therein.

What is claimed is:

1. A coupling assembly for releasably connecting a drill body to a stakedown assembly in a horizontal directional drill, comprising:

a) a first coupling member pivotally having a mounting plate for mounting on the drill body and a second coupling member having means for rigidly mounting on the stakedown assembly;

b) said second coupling member including a longitudinally elongated well formed between a rearwardly inclined front wall and a rear wall, said rear wall having a longitudinally extending locking aperture formed therethrough;

c) said first coupling member including a longitudinally extending horizontal base plate, a rearwardly inclined face plate extending upwardly therefrom and a tail plate extending upwardly therefrom, said tail plate have a longitudinally extending opening therethrough; and d) a locking mechanism mounted on said horizontal base plate;

e) said locking mechanism including a horizontal oriented locking pin slidable longitudinally of said base plate, said locking pin having a locking tip on its rear end arranged so said tip can pass through said aperture and said opening when said first coupling member is seated on said second coupling member between said front and rear walls;

f) said locking mechanism further including an actuator lever pivotally mounted on said base plate, said actuator lever having an actuator leg and an actuator foot, said foot extending generally perpendicular to said leg, said lever being pivotally mounted on said base plate approximately at the juncture of said leg and foot, said foot having a toe at its free end on which a cam surface is formed;

g) said locking mechanism also including an actuator rod for said locking pin, said actuator rod being pivotally connected to the front end of said pin and extending slidably through a connector block pivotally mounted on said toe, said rod having a washer slidable on it and a spring around it, said spring biasing said washer into engagement with said cam surface;

h) wherein pivoting of said lever in one direction is effective to move said cam toward said locking pin and, through said washer and spring, resiliently drive said pin into locking position with its tip extending through said opening, said lever being pivotable in said one direction until it has pivoted the pivot axis of said connector block past dead center relative to a straight line between the axis of the pivot connection between the rod and the pin and said connector block pivot axis.

2. The coupling of claim 1 further characterized in that:

a) said rear wall is rearwardly inclined; and b) said tail plate is rearwardly inclined.

3. The coupling of claim 1 further characterized in that:

a) said spring comprises a coil spring encircling said actuator rod; and b) said spring is bracketed by two washers, one of which engages said cam surface.

4. The coupling of claim 1 further characterized in that:

a) said first coupling member mounting plate having a pivot axis and a plurality of locking apertures arranged around it.

* * * * *